United States Patent [19]

Hansberry

[11] Patent Number: 4,924,787

[45] Date of Patent: May 15, 1990

[54] APPARATUS FOR FORMING A SEAM

[75] Inventor: Mitchell L. Hansberry, Framingham, Mass.

[73] Assignee: The Charles Stark Draper Laboratory, Inc., Cambridge, Mass.

[21] Appl. No.: 318,656

[22] Filed: Mar. 3, 1989

[51] Int. Cl.[5] ..... D05B 35/02

[52] U.S. Cl. ..... 112/142; 112/153; 112/306

[58] Field of Search ..... 112/141, 142, 147, 153, 112/306

[56] References Cited

U.S. PATENT DOCUMENTS

| | | | |
|---|---|---|---|
| 331,108 | 11/1885 | Arnold . | |
| 1,212,539 | 1/1917 | Molyneux et al. . | |
| 1,844,411 | 2/1932 | Shutzer . | |
| 3,417,718 | 12/1968 | Andersson | 112/203 |
| 3,889,614 | 6/1975 | Nicolay et al. | 112/153 |
| 3,903,820 | 9/1975 | Kleinschmidt et al. | 112/153 |
| 3,994,247 | 11/1976 | Cummins | 112/153 X |
| 4,074,640 | 2/1978 | Chano et al. | 112/121 |
| 4,292,908 | 10/1981 | Blessing | 112/153 X |
| 4,395,963 | 8/1983 | Diacont, Jr. et al. | 112/262 |
| 4,590,871 | 5/1986 | Granville | 112/142 |
| 4,653,414 | 3/1987 | Harrington | 112/142 |
| 4,681,051 | 7/1987 | Kirch et al. | 112/306 |

FOREIGN PATENT DOCUMENTS

| | | | |
|---|---|---|---|
| 132508 | 10/1978 | Fed. Rep. of Germany | 112/306 |
| 2090298A | 12/1981 | United Kingdom . | |

*Primary Examiner*—Werner H. Schroeder
*Assistant Examiner*—David K. Suto
*Attorney, Agent, or Firm*—Lahive & Cockfield

[57] ABSTRACT

A seam forming apparatus for forming a seam in one or more limp material segments includes a fold assembly and a driver for positioning the segments within guide channels in the fold assembly prior to presentation to a seam joining device. The driver controls the segments to be at associated predetermined positions within the fold assembly.

32 Claims, 8 Drawing Sheets

FIG. 2A
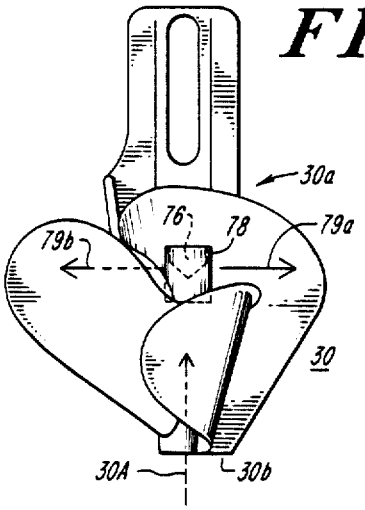
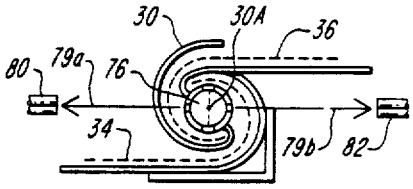
FIG. 2B
FIG. 3A
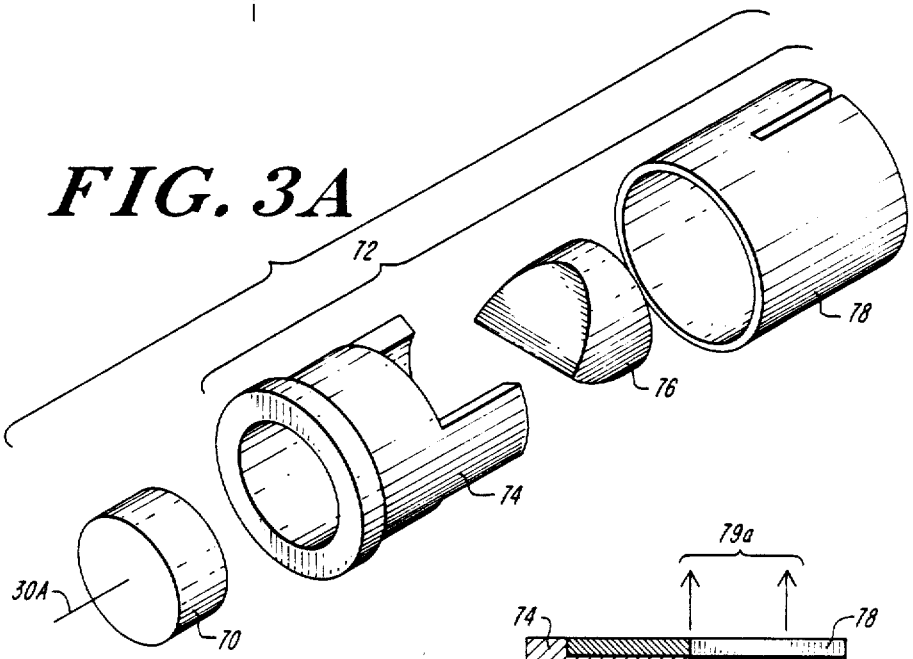
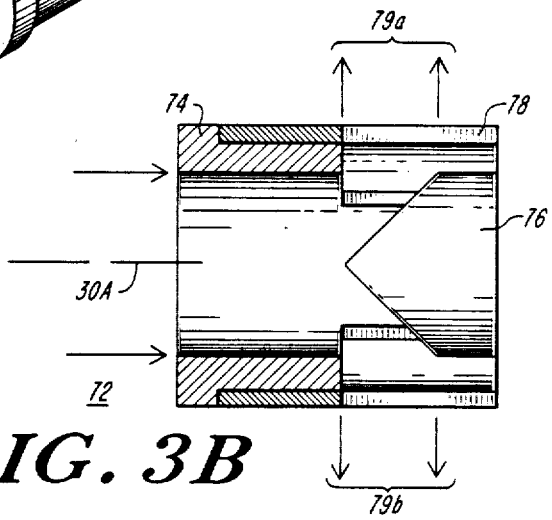
FIG. 3B

FIG. 6A
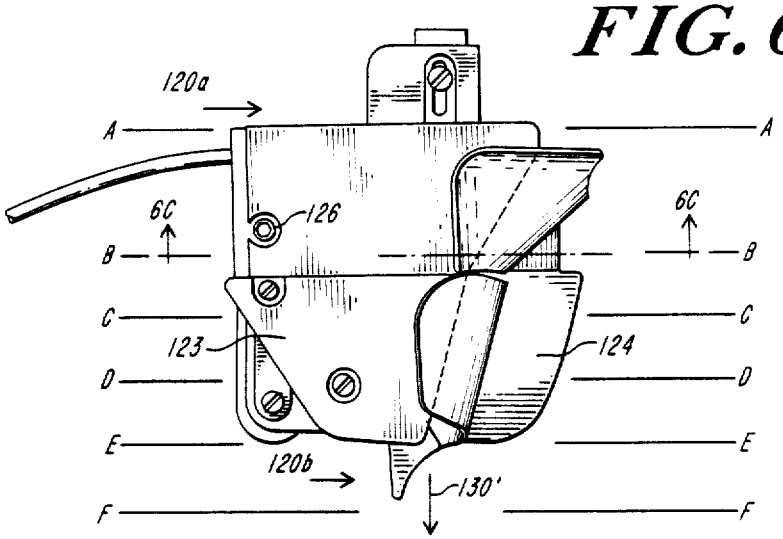
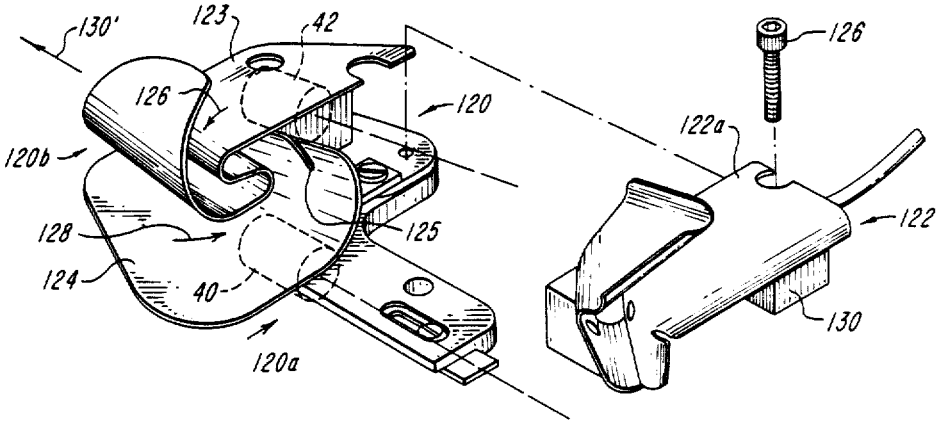
FIG. 6B
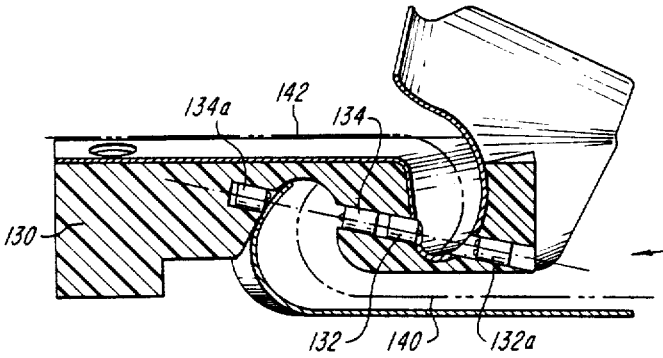
FIG. 6C

APPARATUS FOR FORMING A SEAM

REFERENCE TO RELATED APPLICATION

The subject matter of this application is related to the subject matter of U.S. patent application Ser. No. 319,120, filed on Mar. 3, 1989, entitled "Full Felled Seam Fold Assembly."

BACKGROUND OF THE INVENTION

This invention relates to systems for automatic or computer-controlled manipulation of sheet material during processing, e.g., fabric or other limp material to be assembled at a sewing station.

During the construction of a useful item from raw stock of flat goods (e.g., cloth, paper, plastic, and film), it is often necessary to precisely position and guide the flat goods through a work station. Typical work stations perform assembly operations such as joining, cutting or folding. For example, such work stations can be equipped with sewing machines for joining multiple layers of limp fabric, such as may be from separate limp material segments, or from several regions of the same (folded) limp material segment.

Conventionally, the positioning and guiding of the fabric-to-be-joined is accomplished by skilled human operators. The operators manually feed or advance the fabric-to-be-joined through the stitch forming mechanism of the sewing machine along predetermined seam trajectories on the fabric. The resultant seams can be straight or curved, or a combination of both as is often required in the assembly of fabric panels to form articles of clothing, for example. Typically, the fabric-to-be-joined must be precisely positioned and accurately directed to the sewing head to achieve the desired seam. The human operator must therefore function not only as a "manipulator" of the fabric but also as a real-time "sensing and feedback medium", making small adjustments, e.g., in orientation, fit-up and seam trajectory, to obtain quality finished goods. The adjustments are required, for example, due to variations in seam type, geometry, location and fit-up.

There are many forms of seams that are conventionally formed, such as superimposed seams, lapped seams, bound seams, and edge finishing seams. Such seams are described generally in "The Technology of Thread and Seams", J&P Coats Limited, Glasgow, Scotland (undated), pages 74–79.

One form of seam which is required in the fabrication of certain articles is the so-called full felled or double lapped seam. The full felled seam is typically used to join one lateral edge of each of two limp material segments. In that seam, the edges to be joined are folded over in an interlocking relationship (where their cross-sections form interleaved opposed V's or C's) and then one or two rows of stitches are established along the principal axis of the seam through all four layers of the interlocked segments.

In the prior art, to assist in the formation of such a seam, an operator manually presents and feeds two limp material segments to be joined to a fold assembly coupled to a sewing machine. The fold assembly, for example, a Simanco USA model 230056. is adapted to receive the presented segments and to guide the edges so that at the output end of the fold assembly, the two segments emerge with their lateral edges interlocked and ready for joining. The fold assembly is positioned so that the emerging segments are driven by the feed dogs of the sewing machine to the needle and bobbin assembly of the sewing head of the machine.

One drawback of this technique is that it is labor intensive; that is, a large portion of the cost for manufacture is attributable to manual labor. One of the further problems of the prior art seam forming techniques lies with the conventional fold assembly. With such an assemblY, the formation of straight seams is fairly effective, although considerable manual assistance is required. However, the formation of a curved felled seam is extremely difficult, due to bunching of the limp material segments as they are fed to and drawn through the fold assembly.

To reduce labor cost in the clothing assembly industry, automated or computer-controlled manufacturing techniques have been developed for many of the desired assembly operations. However, there have not been any effective techniques developed for the automated formation of high quality full felled seams. Moreover, even the manual assisted techniques have limited effectiveness due to the required degree of human intervention and are limited in their ability to accommodate curved seams.

Accordingly, it is an object of the invention to provide an improved method and apparatus for positioning and guiding sheet material, e.g., fabric or other limp material to be processed, in the formation of seams.

It is another object of the present invention to provide an improved flat-material manipulation device suitable for automatic or computer-controlled seam forming operations, which is of simple, rugged, versatile, and economical design.

SUMMARY OF THE INVENTION

These and other objects of the invention are accomplished by an improved apparatus for controlling the position of sheet material, e.g., fabric or other flat goods, slidingly supported on a work surface with a relatively low coefficient of friction.

The present invention is a seam forming apparatus for forming a seam at one lateral edge of one limp material segment (e.g. an edge finishing seam, such as a hem), or at one lateral edge of each of two limp material segments.

The apparatus includes a fold assembly extending along a reference axis from an input end to an output end. The fold assembly establishes a first segment guide channel adapted to receive a first of the limp material segments. That first segment guide channel extends from the input end to the output end, and is open at the input end and at one lateral side.

In some forms of the invention adapted for joining two limp material segments, the fold assembly also establishes a second segment guide channel adapted to receive the second of the limp material segments. That second segment guide channel also extends from the input end to the output end, and is open at the input end and at one lateral side.

The first and second segment guide channels each extend about an associated channel axis extending substantially parallel to the reference axis near the output end of the fold assembly.

For a full felled seam, the two segment guide channels of the fold assembly have substantially V- (or C-) shaped cross-sections, and the first and second channels are oppositely directed and interleaved near the output end. As used herein, the terms "V-" and "C-" are used interchangeably to define a shape which curves about a central point, either in a continuous or piecewise continuous manner.

In one form, the invention further includes two feed plane support members. That first feed plane support member has a segment support surface extending substantially to the lower surface of the portion of the first segment guide channel above its associated channel axis at the input end of the fold assembly. The second feed plane support member has a material support surface extending substantially to the lower surface of the portion of the second segment guide channel at the input end of the fold assembly.

A position controller controls the position of the lateral edges of the segments in the channels to be at associated predetermined positions measured with respect to the reference axis at a point along that axis between the input and output ends of the fold assembly. Generally, the controlled edges are laterally spaced apart from the reference axis by an associated predetermined distance near the input end of the fold assembly. The segment edge positions are controlled bidirectionally, and pursuant to a closed loop control system.

In various forms of the invention, the position controller includes segment edge sensors between the input end and output end of the fold assembly. Those edge sensors are adapted to generate position signals representative of the positions with respect to the reference axis of the lateral edges of the limp material segments in their respective channels. Segment drivers are responsive to the position signals for controlling the lateral edges of the segments to be at their associated predetermined positions.

Preferably, the edge sensors are positioned between the segment drivers and the output end of the fold assembly, although in some forms, this configuration may be reversed.

The segment drivers each include a rotatable drive wheel adapted for rotation about an axis substantially parallel to the reference axis. The wheels have their respective lateral surfaces opposite to a platen substantially coincident with a surface of a respective one of the segment guide channels near the input end of the fold assembly.

Preferably, at least one of the platens and the drive wheel surface opposite thereto is positioned within the respective one of the segment guide channels.

The preferred form of the invention is further adapted to selectively bias the outer surfaces of the drive wheels toward their respective platens. By differentially biasing the drive wheels toward their respective platens, differing drags may be established in the two segments, so that a desired relative stretching may be achieved. The lateral surfaces of the drive wheels may selectively be positioned away from their respective platens to permit easy loading of segments to the fold assembly. With the wheels biased toward their respective platens, drive motors coupled to the wheels control the rotational motion of the wheels, together or independently, to establish control of the limp material segment positions within the fold assembly.

The above-described seam forming apparatus may be integrated with the sewing head and feed dog assembly of a sewing machine to form an automated full felled seam forming system. With this configuration, two segments-to-be-joined may be readily loaded in separate (and overlapping) feed planes to the fold assembly. Then, the sewing head may be actuated so that the feed dog assembly draws the two segments through the fold assembly to the needles of the sewing head. As the segments are drawn through the fold assembly, the position of the lateral edges are dynamicallY controlled to establish a high quality seam.

BRIEF DESCRIPTION OF THE DRAWINGS

For a fuller understanding of the features, advantages, and objects of the invention, reference should be made to the following detailed description and the accompanying drawings, in which:

FIG. 2A is a top view of the fold assembly of the system of FIG. 1;

FIG. 2B is a side elevation view from the input end of the fold assembly of FIG. 1;

FIG. 3A is an exploded view of the light source of the optical detector of the system of FIG. 1;

FIG. 3B is a sectional view of the reflector assembly of FIG. 3A;

FIG. 6A shows a plan view of the fold assembly Of the System of FIG. 5;

FIG. 6B shows an exploded perspective view of the fold assembly and sensor assembly of the system of FIG. 5;

FIG. 6C shows a sectional view along lines 6C—6C of the sensor assembly of the system of FIG. 6A;

DESCRIPTION OF THE PREFERRED EMBODIMENT

Figure 1:
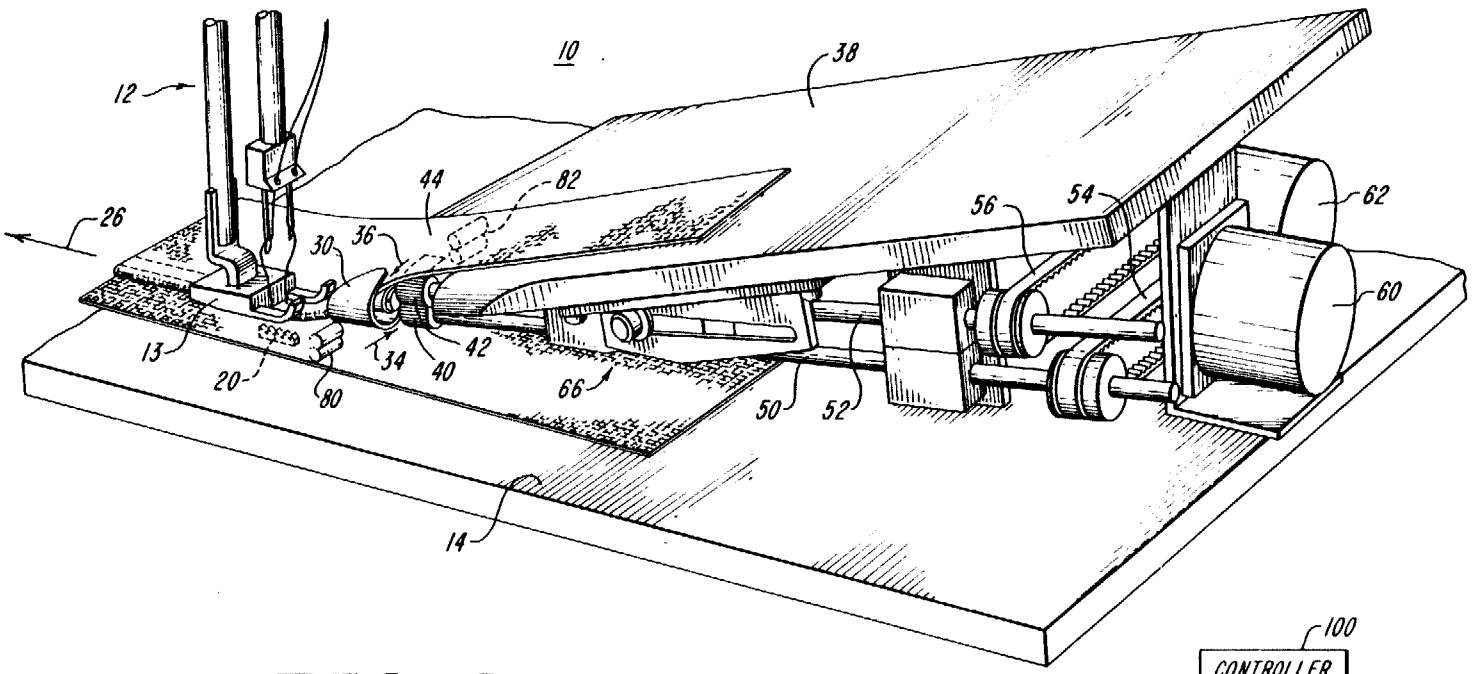
FIG. 1 is a perspective view of an apparatus for forming a full felled seam in accordance with the present invention.

A seam forming system 10 embodying the invention is shown in FIG. 1. System 10 includes a conventional dual needle sewing head 12 of a flat bed sewing machine. Sewing head 12 is positioned over a work support surface 14 which overlies a conventional dual bobbin assembly (not shown). A pair of conventionally operative feed dog assemblies are positioned with their drive elements 20 and 22 (not shown) extending through the top of work surface 14. The presser foot 13 of head 12 biases the segments against the feed dogs 20 and 22 so that the feed dog assemblies selectively drive a limp material workpiece along a reference axis 26 toward the needles of the sewing head 12.

The system 10 further includes a fold assembly 30 positioned on the work surface 14. The fold assembly 30 defines two limp material segment guide channels 34 and 36 extending laterally into the fold assembly 30, and includes an optical position detection system 37, described in detail below in conjunction with FIG. 4. The workpiece support surface 14 provides a limp material segment support surface leading to the channel 34 and a support element 38 provides a limp material segment support surface leading to channel 36. The channels 34 and 36 are open at the input end of fold assembly 30 and along one lateral side, permitting positioning therein of the lead edges of limp material segments on surfaces 14 and 38.

A first segment drive wheel 40 is positioned with its central axis substantially parallel to axis 26 and its lateral surface adjacent to an effective platen established by the support surface 14. A second segment drive wheel 42 is positioned with its central axis substantially parallel to axis 26 and with its lateral surface adjacent to a platen 44 (shown with broken lines) which overlies the extended plane of support surface 38. The wheels 40 and 42 include axially directed ridges on their lateral surfaces.

The drive wheels 40 and 42 are coupled by respective ones of flexible drive shafts 50, 52 and belts 54, 56 to a respective one of stepper motors 60 and 62.

The drive wheels 40 and 42 are generally biased away from each other, i.e. so that wheel 40 is biased toward surface 14 and wheel 42 is biased toward surface 38. A drive wheel biasing assembly 66, including an associated actuator (not shown), is coupled to the shafts 50 and 52. That assembly 66 is selectively operative to establish the above-noted bias to wheels 40 and 42, or to remove that bias and withdraw wheel 40 from surface 14 and wheel 42 from platen 44. When the wheels 40 and 42 are biased toward surfaces 14 and 38, respectively, limp material segments in the guide channels may be controlled by movement of the wheels. When the wheels 40 and 42 are displaced from the surfaces, segments may be easily loaded or removed from the channels.

In the embodiment of FIG. 1, a linear actuator is used to selectively drive a wedge-shaped element, or cam 68, in the direction of axis 26 to either push apart (in the forward position, as shown in FIG. 1) the shafts 50 and 52, or permit a biasing spring, not shown, to push the wheels together (i.e. away from their respective platens).

A controller 100 is selectively operable to control the operation of the sewing head 12 and its associated feed dog assembly, the optical detection system 37 and the position and rotarY motion of the drive wheels 40 and 42.

In the system 10 of FIG. 1, the fold assembly 30 is similar to a Simanco USA model 230056 folder, which has been modified to include an optical position detection system 37. Fold assembly 30, shown in FIGS. 2A and 2B extends from an input end 30*a* to an output end 30*b* along a principal axis 30A. Assembly 30 defines two segment guide channels (having cross-sections indicated bY the broken lines in FIG. 2B) which extend laterally into assembly 30 and curl around the principal axis 30A of assembly 30. Axis 30A effectively provides a reference (or channel) axis about which the cross-section of the channels extend. While offset somewhat from axis 26, axis 30A is "substantially" parallel to axis 26 near the output end of assembly 30.

Figure 4:
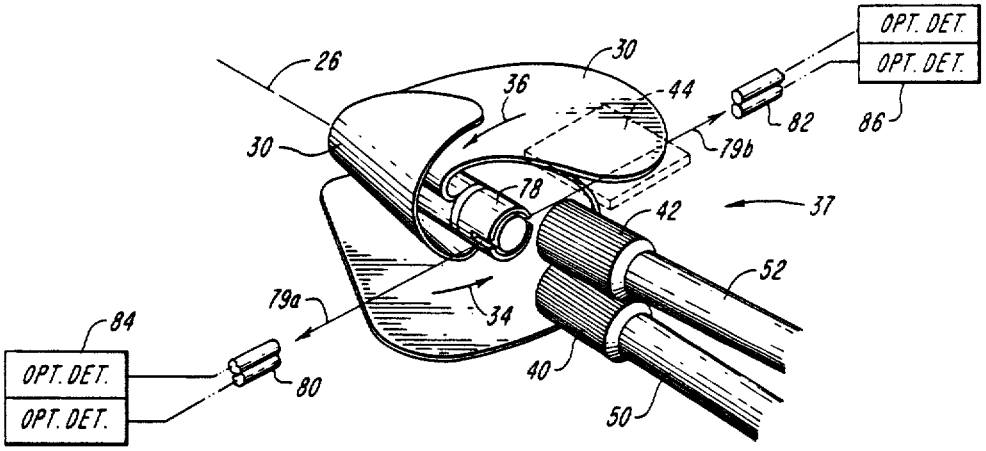
FIG. 4 is a perspective view of the fold assembly and segment position controller of the system of FIG. 1.

The assembly 30 includes the optical source and reflector portions of the optical detection system 37. As shown in FIG. 3A, these portions include a light emitting diode (LED) 70 and a dual beam forming reflector assembly 72. The assembly 72, shown in assembled form in FIG. 3B, includes a housing 74, a reflector 76 and a collimator 78. With this configuration, light from LED 70 is split by reflector 76 to form two laterally (with respect to axis 30A) directed beams. As shown in FIG. 4, the beams from reflector 76 are directed across the respective segment guide channels of assembly 30 along propagation paths 79*a* and 79*b* to be incident upon the input ends of respective pairs of optical fibers 80 and 82 leading to corresponding pairs of optical detectors 84 and 86 (illustrated in block diagram form in FIG. 4). The optical fiber pairs 80 and 82 are mounted in a housing (not shown) affixed to assembly 30. The optical detectors are operative in conjunction with the controller 100 to identify when a limp material segment in one of the channels 34, 36 blocks the beam from LED 70 from none, one or both of the input ends of the optical fiber pairs.

In operation of the system of FIG. 1, the actuator for assembly 66 is initially positioned so that the wheels 40 and 42 are drawn back from the respective surfaces of surface 14 and platen 44. Then a first limp material segment 101 is positioned between wheels 40 and surface 14 and a second limp material segment 102 is positioned between wheel 42 and platen 44. The two segments are then pushed through the fold assembly 30 to overlie the feed dogs 20 and 22. Then the actuator of assembly 66 is positioned to bias wheels 40 and 42 against surface 14 and platen 44 respectively to engage the respective limp material segments 101 and 102.

Then the feed dogs 20 and 22 and sewing head 12 are actuated to draw the limp material segments 101 and 102 through the fold assembly 30. As the segments are drawn through the assembly 30, the controller determines the position of the lateral edge of those segments bY monitoring the optical detectors 84 and 86. Under closed loop control, the wheels 40 and 42 are selectively driven bidirectionally, as necessary, so that the lateral edges of the segments cover just one fiber of the fiber pairs 80 and 82 as the segments 101 and 102 are drawn through assembly 30. The axially extending grooves in the lateral surfaces of wheels 40 and 42 permit axial motion of the segments, while resisting lateral movement, except in response to rotary motion of the wheels.

With this configuration, where the position of the lateral edges of the segments is automatically controlled between the drive wheels and the feed dogs, a highly accurate full felled seam may be established, on a continuous basis and without manual intervention. In alternative configurations, the relative positions of the wheels and the optical detectors may be reversed. In some embodiments of the invention, the bias pressure of the wheels 40 and 42 toward their respective platens may be independently varied to provide desired drag forces to the respective material segments passing in the direction of axis 26. With such control, selective stretching of one segment with respect to the other may be attained in a seam.

Figure 5:
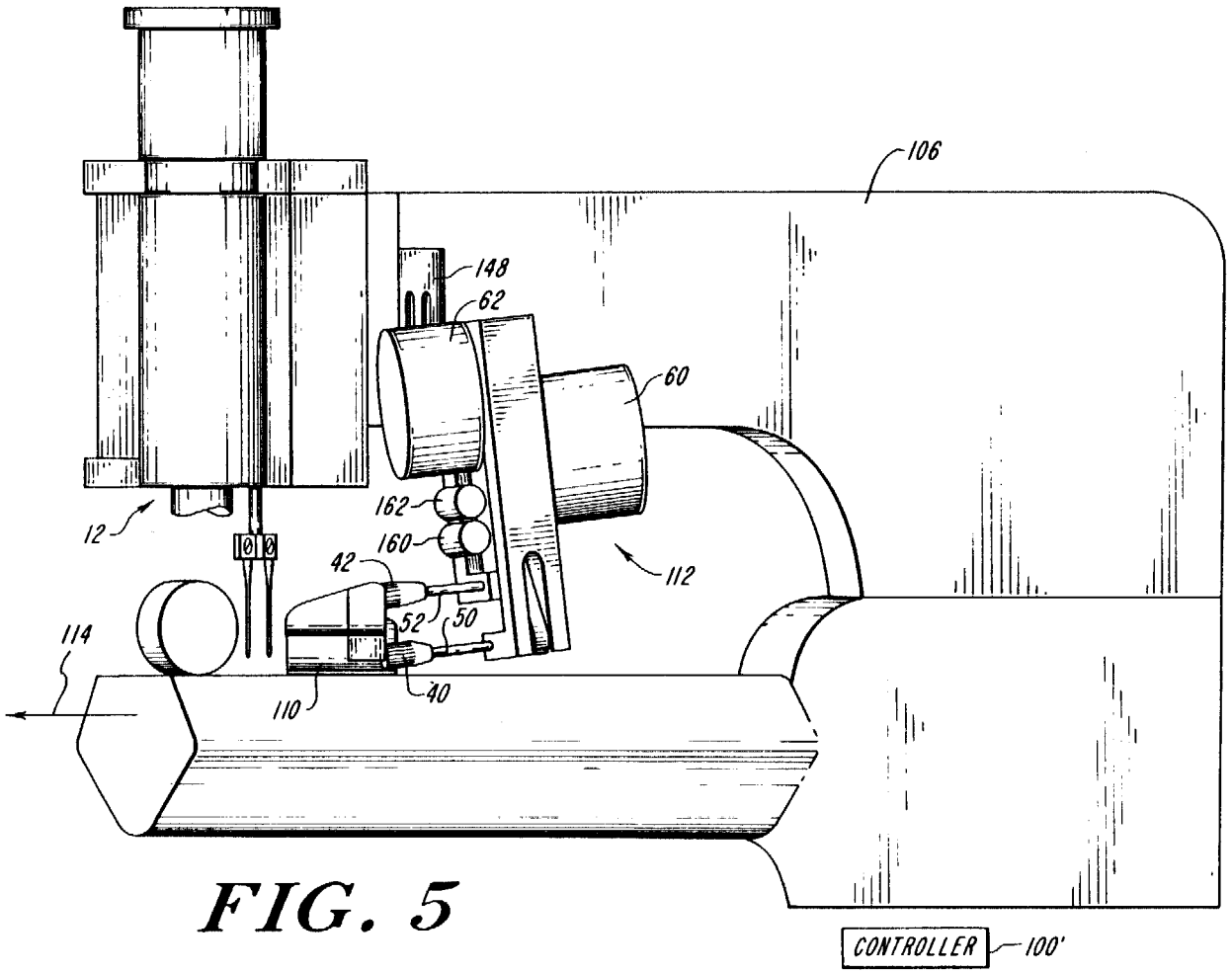
FIG. 5 shows an embodiment of the invention adapted for a feed-off-the-arm sewing machine.

An alternative configuration embodying the invention is shown generally in FIG. 5. In that configuration, a feed-off-the-arm sewing machine 106 is fitted with a fold assembly 110 and a drive wheel/bias assembly 112. The fold assembly 110 is described below in conjunction with FIGS. 6A, 6B and 6C, and the drive wheel/bias assembly 112 is described below in conjunction with FIGS. 7A, 7B and 7C. In those figures, elements which correspond to elements in FIGS. 1–4 are denoted with identical reference numerals. In operation, limp material segments are folded in assembly 110 and drawn along an axis 114 toward the needles of machine 106.

The fold assembly 110 is shown in detailed form in FIGS. 6A, 6B and 6C. Assembly 110 includes a folder 120 and a sensor assembly 122 of the optical detection system 37. In the illustrated form, folder 120 includes two curved metal elements 123 and 124 that define a pair of oppositely directed V- (or C-) shaped segment guide channels 126, 128 extending along an axis 130' from an input end **120*a* to an output end 120*b*. The folder 120 is similar to a type 752-D folder, manufactured by Atlanta Attachment Company, Inc., in which the element 123 has been partially cut away, and a slot 125 has been placed in element 124, in order to accommodate the sensor assembly 122 that is affixed to folder 120 by a screw 126**.

The sensor assembly 122 includes a housing 130 and a pair of internally positioned, oppositely directed light emitting diodes 132, 134 and associated pairs of photodetectors **132*a*, 134*a*. The housing 130 defines extensions to the segment guide channels 126, 128, and also includes a surface 122*a* which establishes an extension to the top surface of element 123. The diode/detector pair 132/132*a* are positioned to detect a limp material segment 142 in the extension to channel 126. The diode/detector pair 134/134*a* (positioned along a sensing axis passing through the slot 125) are positioned to detect a limp material segment 140 in the extension to channel 128**.

Figure 7B:
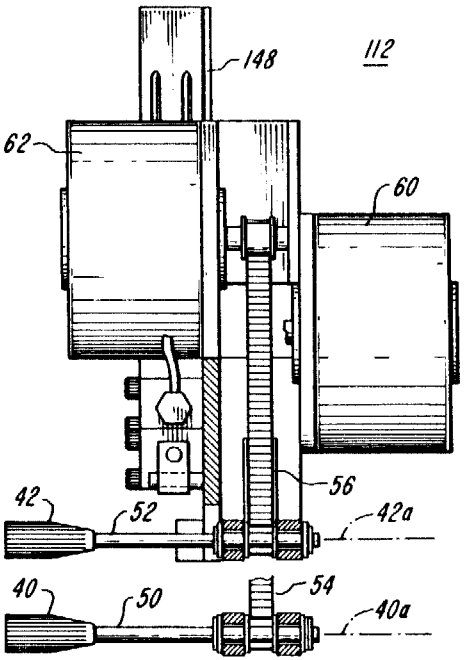
FIG. 7B shows a sectional view along lines 7B—7B of the drive wheel biasing assembly of FIG. 7A.
Figure 7A:
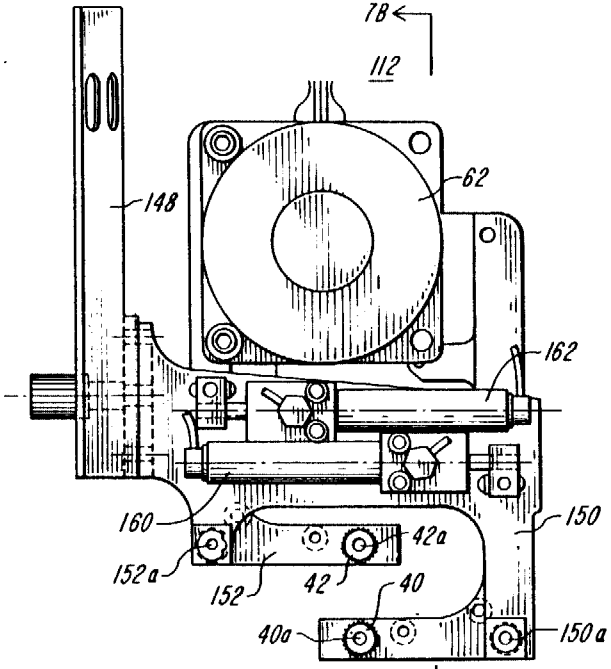
FIG. 7A shows a front plan view of an alternative drive wheel biasing assembly.
Figure 7C:
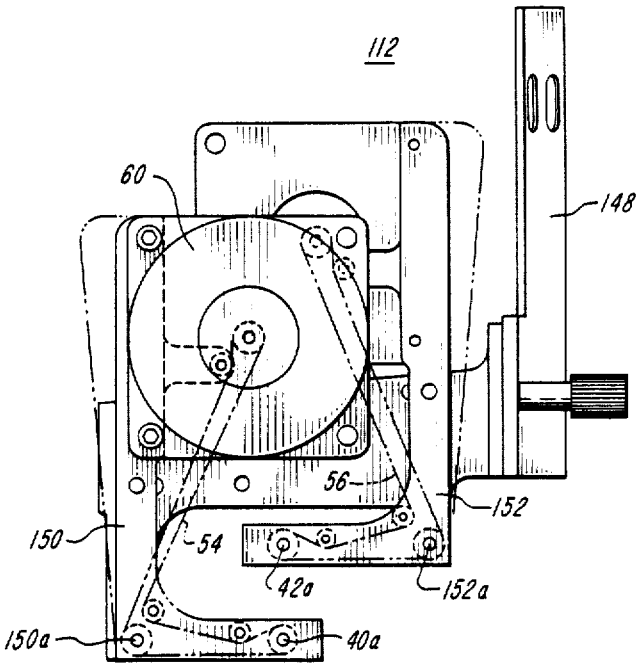
FIG. 7C shows a rear plan view of the drive wheel biasing assembly of FIG. 7A.

A pair of drive wheels 40 and 42 from drive wheel/bias assembly 112, described below in conjunction with FIGS. 7A, 7B and 7C, are adapted to be selectively biased toward or away from the upper surface of element 124 and surface **122*a*** which function as platens.

The drive/wheel bias assembly 112 is shown in FIGS. 7A, 7B and 7C. The assembly 112 includes a support member 148 which is affixed to the sewing machine 106. Assembly 112 also includes drive wheels 40 and 42 (rotatable about axes **40*a* and 42*a*, respectively), drive belts 54 and 56, drive shafts 50 and 52, and drive motors 60 and 62, all of which correspond in function to the similarly referenced elements in the configuration of FIG. 1**.

The shaft 50 and wheel 40 are positioned on an arm 150 which is pivoted about a first pivot axis **150*a* and the shaft 52 and wheel 42 are positioned on an arm 152 which is pivoted about a second pivot axis 152*a*. Linear actuators 160 and 162 are selectively operable to shift the positions of arms 150 and 152 so that the wheels 40 and 42 are biased toward (as illustrated with solid lines in FIG. 7C) or withdrawn (as illustrated in phantom in FIG. 7C) from their respective platens. When the wheels are biased toward their respective platens, positional control of segments 140 and 142 is attained. When the wheels are displaced from their respective platens, the segments 140 and 142 may readily be loaded into or removed from the fold assembly 110**.

A controller 100' functions in a similar manner to controller 100 in the configuration of FIGS. 1–4 to control the operation of the sewing head of machine 106 (including sewing head 12 and its associated feed dog assembly), the optical detection system 37 and the position and rotary motion of drive wheels 40 and 42.

Figure 8A:
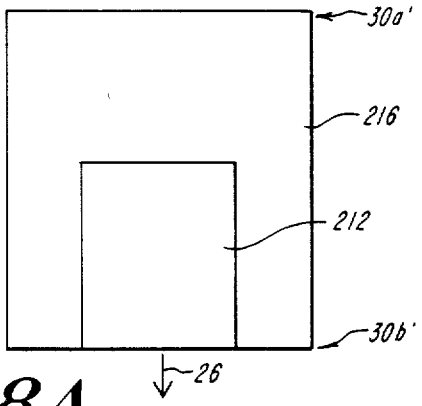
FIG. 8A is a top Plan view of an alternative fold assembly for use in the system of FIG. 1.
Figure 8B:
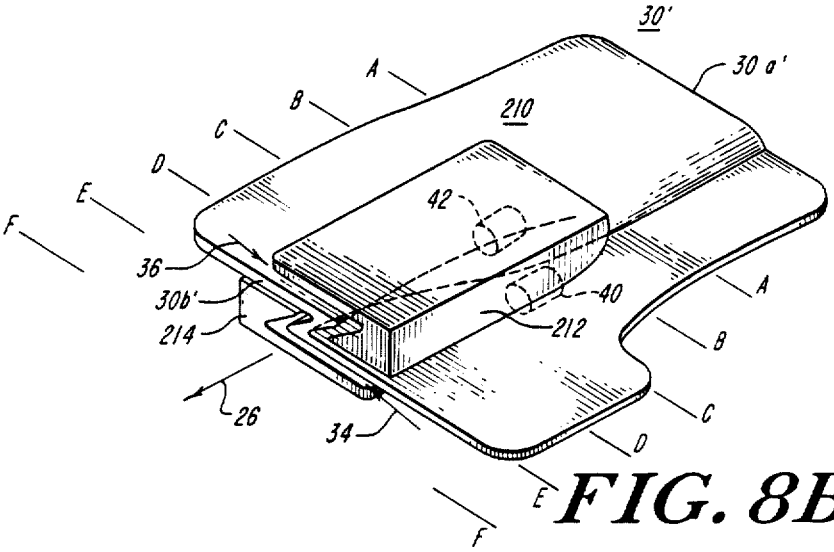
FIG. 8B is a perspective view of the fold assembly of FIG. 8A.
Figure 8C:
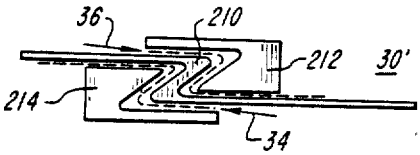
FIG. 8C is a side elevation view from the output end of the fold assembly of FIG. 8A.

FIGS. 8A, 8B and 8C illustrate another alternate form 30' for the fold assembly 30 in the system of FIG. 1. Elements in FIGS. 8A, 8B and 8C which correspond to elements in FIG. 1 are identified by the same reference designations.

The fold assembly 30' includes a rigid central member 210 extending along reference axis 26 from the input end **30*a'* to the output end 30*b'*. The input end 30*a'* of member 210 has a substantially I-shaped cross-section and the output end 30*b'* has a substantially Z-shaped cross-section. As used herein, the term "I-shaped" refers to a substantially straight line shape, and the term "Z-shaped" refers to a substantially third order curve or piece-wise linear equivalent where the regions at and near the maximum/minimum points are referred to as vertices. The intermediate portions of member 210 have a substantially continuously decreasing Z-shaped cross-section along axis 26** from the output end to the input end. As used herein, the term "continuously decreasing Z-shaped" refers to a shape that substantially continuously changes from Z-shaped to I-shaped.

A rigid upper guide member 212 (shown in broken lines in FIG. 8B), having an inner surface V-shaped cross-section, is positioned above member 210 to establish an upper segment guide channel 36. Similarly, a rigid lower guide member 214, having an inner surface with a V-shaped cross-section, is positioned below member 210 to establish a lower segment guide channel 34. As used herein, the term "V-shaped" refers to a second order curve, or piecewise continuous equivalent where the region at or near the maximum/minimum point is referred to as a vertex.

Optical sensors in members 210, 212 and 214 provide signals representative of the limp material segment position within channels 34 and 36. With the illustrated configuration, the sensors may be positioned between lines D—D and E—E (i.e. near the output end **30*b'*) to permit near-needle segment control. Drive wheels 40 and 42 shown in phantom in FIG. 8B) are affixed to central member 210. The bottom and top surfaces, respectively, of members 212 and 214 are selectively biased toward or away from the wheels. When biased toward the wheels, in response to the sensed position of limp material segments in channels 34 and 36**, the wheels are driven to achieve positional control of the limp material segments.

Figure 9A:
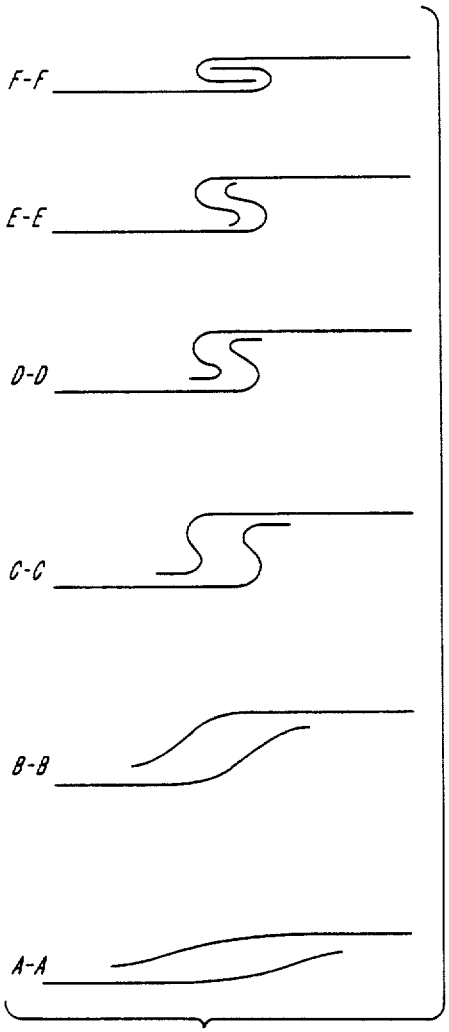
FIG. 9A shows a representation of the cross-sections of limp material segments in the fold assembly of FIGS. 8A, 8B and 8C along lines A—A through F—F.
Figure 9B:
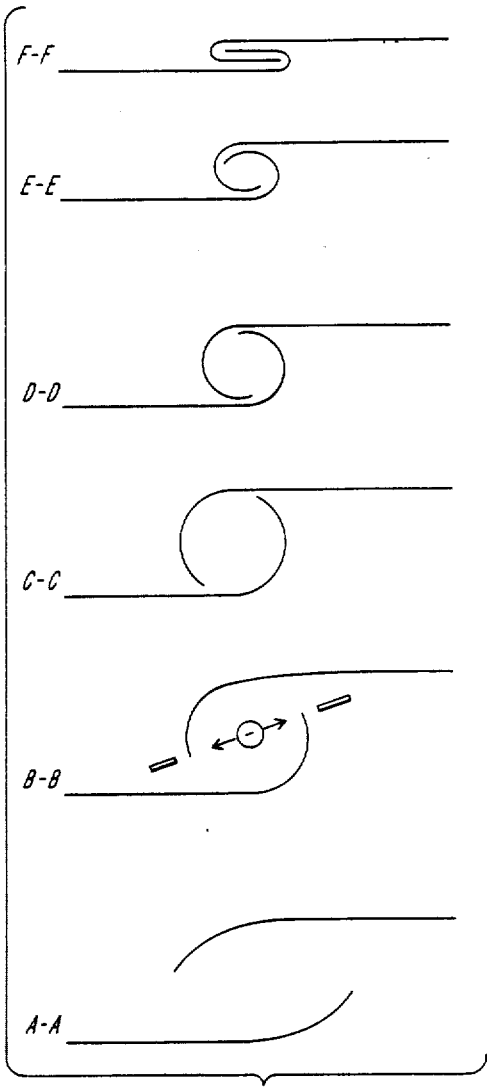
FIG. 9B shows a representation of the cross-sections of limp material segments in the fold assembly of FIGS. 6A, 6B and 6C along lines A—A through F—F.

With the configuration of FIGS. 8A, 8B and 8C, the segment guide channels 34 and 36 have adjacent Z-shaped cross-sections near the output end **30*b'* of fold assembly 30'. As a result, limp material segments positioned in channels 34 and 36 are successively transferred from having adjacent substantially planar cross-sections near the input end 30*a'*, to have adjacent Z-shaped cross-sections at intermediate points between input end 30*a'* and output end 30*b'*, and to have oppositely-directed, interleaved V-shaped cross-sections near output end 30*b'*. The control of the limp material segment geometry in this manner permits particularly effective formation of a full-felled seam. For comparison purposes, the segment geometry for limp material segments S1 and S2 in the fold assembly 30' and for fold assembly 110 is shown (along lines A—A through F—F viewed from the input end) in FIGS. 9A and 9B**, respectively.

Figure 10:
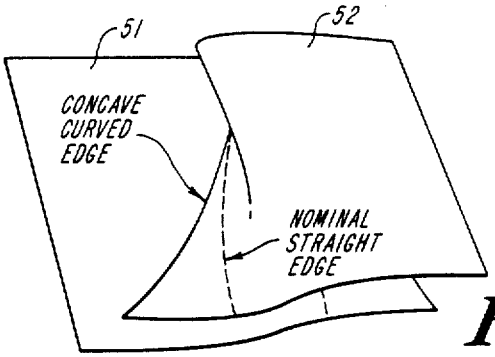
FIG. 10 shows two curved edge limp material segments as positioned in the fold assembly of FIGS. 8A, 8B and 8C.

With the illustrated fold assembly 30', material segments bearing relatively high curvature lateral edges (such as a 3-inch radius, 45° arc length, curved edge) may be fed into channels 34 and 36, for example, as illustrated for curved segments S1 and S2 of FIG. 10. Such segments may be drawn through the fold assembly 30' readily and presented to the sewing head to establish a curved full felled seam.

The preferred embodiments of the present invention have been described above in a form adapted for forming a full felled seam at the lateral edges of two limp material segments. In alternate forms, different seam configurations may be attained. For example, a fold assembly may be used which provides only a single segment guide channel and drive wheel, wherein a drive wheel may be used to bidirectionallY control the segment position to establish segment position for a high quality hem. Alternatively, still different fold assemblies may be used to form folded segment geometries for other seams.

The invention can be embodied in other specific forms without departing from the spirit or essential characteristics thereof. The described embodiments of the invention are to be considered in all respects as illustrative and not restrictive, the scope of the invention being indicated by the appended claims rather than the foregoing description, and all changes which come within the meaning and range of equivalency of the claims are therefore intended to be embraced therein.

I claim:

1. Seam forming apparatus for forming a seam near one lateral edge of each of one or more limp material segments, comprising:

A. a fold assembly extending along a reference axis from an input end of said fold assembly to an output end of said fold assembly and including means establishing a first segment guide channel including means for receiving a first of said limp material segments, said first segment guide channel extending from said input end to said output end, and being open at said input end and at one lateral side thereof, and having a cross-section extending about an associated first channel axis extending substantially parallel to said reference axis near said output end, B. positioning means for actively bidirectionally controlling the position of said lateral edges of said segments to be at associated predetermined positions with respect to said reference axis at a point along said reference axis between said input end and said output end of said fold assembly.

2. The apparatus according to claim 1 further comprising:

means for establishing a second segment guide channel including means for receiving a second of said limp material segments, said second segment guide channel extending from said input end to said output end and having a cross-section extending about an associated second channel axis substantially parallel to said reference axis near said output end, said first and second channels being at least partially overlapped near said output end.

3. The apparatus according to claim 2 wherein the cross-sections of first and second segment guide channels are substantially V-shaped and oppositely directed and interleaved near said output end.

4. The apparatus according to claim 2, wherein said positioning means comprises:

A. first segment edge sensor near said input end of said fold assembly and including means for generating a first signal representative of the position of said lateral edge of said first segment within said first segment drive channel, B. first segment drive means responsive to said first signal for controlling said lateral edge of said first segment to be at its associated predetermined position, C. second segment edge sensor near said input end of said fold assembly and including means for generating a second signal representative of the position of said lateral edge of said second segment within said second segment drive channel, and D. second segment drive means responsive to said second signal for controlling said lateral edge to be at its associated predetermined position.

5. The apparatus according to claim 4 wherein said first and second segment edge sensors are positioned between said first and second segment drive means, respectively, and said output end of said fold assembly.

6. The apparatus according to claim 4 wherein said first and second segment edge sensors are positioned between said first and second drive means, respectively, and said input end of said fold assembly.

7. The apparatus according to claim 4 wherein said first and second segment drive means each include a rotatable drive wheel adapted for rotation about an axis substantially parallel to said reference axis, and having its lateral surface opposite to a platen substantially coincident with a surface of a respective one of said segment guide channels near said input end of said fold assembly.

8. The apparatus according to claim 7 wherein at least one of said platens and said drive wheel surface opposite thereto is positioned within the respective one of said segment guide channels.

9. The apparatus according to claim 8 wherein said first and second segment edge sensors are positioned between said segment drive means and said output end of said fold assembly.

10. The apparatus according to claim 8 further including means for selectively biasing the lateral surfaces of said drive wheels and the respective ones of said platens toward each other.

11. The apparatus according to claim 10 further including at least one selectively operable motor having an output shaft, and a means for coupling said output shaft to at least one of said drive wheels.

12. The apparatus according to claim 11 wherein said coupling means includes a flexible shaft coupling each of said drive wheels to a selectively operable motor, and further includes a selectively operable displacing means for displacing said lateral surfaces of said drive wheels from the respective ones of said platens.

13. The apparatus according to claim 12 wherein said displacing means includes means for positioning said flexible shafts to be adjacent, means for biasing said shafts toward each other, a wedge-shaped member positioned between said shafts, a selectively operable actuator including means for selectively moving said wedge-shaped member between two positions whereby at one of said positions, said lateral surfaces of said drive wheels are biased towards and adjacent to the respective ones of said platens, and at the other of said positions, said lateral surfaces of said drive wheels are offset from the respective ones of said platens.

14. The apparatus according to claim 11 wherein said biasing means includes a base member affixed to said fold assembly, at least one motor support member pivotally coupled to said base member, means for affixing each of said motors to an associated one or said motor support members, and means for selectively biasing said output shaft in a first state whereby said lateral surfaces of said drive wheels are biased towards and adjacent to the respective ones of said platens and in a second state whereby said lateral surfaces of said drive wheels are offset from the respective ones of said platens.

15. The apparatus according to claim 1, wherein said positioning means comprises:

A. first segment edge sensor near said input end of said fold assembly and including means for generating a first signal representative of the position of said lateral edge of said first segment within said first segment guide channel, B. first segment drive means responsive to said first signal for controlling the separation of said lateral edge of said first segment to be at its associated predetermined position.

16. The apparatus according to claim 15 wherein said first segment edge sensor is positioned between said first segment drive means and said output end of said fold assembly.

17. The apparatus according to claim 15 wherein said first segment drive means includes a rotatable drive wheel adapted for rotation about an axis substantially parallel to said reference axis, and having its lateral surface opposite to a platen substantially coincident with a surface of said segment guide channel near said input end of said fold assembly.

18. The apparatus according to claim 17 wherein said platen and said drive wheel surface opposite thereto is positioned within said segment guide channel.

19. The apparatus according to claim 18 wherein said first segment edge sensor is positioned between said segment drive means and said output end of said fold assembly.

20. The apparatus according to claim 18 further including means for selectively biasing the lateral surfaces of said drive wheels and the respective ones of said platens toward each other.

21. The apparatus according to claim 1 wherein said fold assembly comprises:

A. a rigid central member extending along said reference axis and having a substantially Z-shaped cross-section at said output end defining an upper vertex and a lower vertex at said output end and having a substantially I-shaped cross-section at said input end, said Z-shaped cross-section being substantially symmetrically disposed about said reference axis, and said central member having a substantially continuously decreasing Z-shape cross-section between said output end and said input end, B. a rigid upper guide member having an inner surface with a substantially V-shaped cross-section, C. means for positioning said rigid upper guide member adjacent to the upper surface of said central member, wherein the inner surface of said upper guide member is disposed near said output end of said central member and opposed to and offset from the upper vertex of said Z-shaped portion of said central member, thereby forming a segment guide channel, D. a rigid lower guide member having an inner surface with a substantially V-shaped cross-section and, E. means for positioning said rigid lower guide member adjacent to the lower surface of said central member, wherein said inner surface of said lower guide member is disposed near said output end and opposed to and offset from the lower vertex of said Z-shaped portion of said central member, thereby forming a segment guide channel.

22. Seam forming apparatus according to claim 21 further comprising means adjacent to said output end for drawing said limp material segments from said segment guide channels in the direction of said reference axis.

23. Seam forming apparatus according to claim 22 wherein said drawing means includes a feed dog assembly.

24. Seam forming apparatus according to claim 22 further comprising a seam joining apparatus including means for receiving said limp material segments from said drawing means along said reference axis and means for sewing said received limp material segments along a sewing axis substantially parallel to said reference axis.

25. The apparatus according to claim 1 wherein said fold assembly comprises:

means for constraining the portions of said first and second segments adjacent to said lateral edge to be substantially adjacent and substantially straight in the direction transverse to said reference axis at points near said input end, means for constraining said portions to be substantially adjacent and substantially Z-shaped in the direction transverse to said reference axis between said points within said assembly near said input end and points near said output end, means for constraining said portions to be substantially V-shaped in the direction transverse to said reference axis and oppositely-directed and interleaved at points outside said assembly and near said output end.

26. The apparatus according to claim 25 wherein said fold assembly comprises:

A. a rigid central member extending along said reference axis and having a substantially Z-shaped cross-section at said output end defining an upper vertex and a lower vertex at said output end and having a substantially I-shaped cross-section being substantially symmetrically disposed about said reference axis, and said central member having a substantially continuously decreasing Z-shape cross-section between said output end and said input end, B. a rigid upper guide member having an inner surface with a substantially V-shaped cross-section, C. means for positioning said rigid upper guide member adjacent to the upper surface of said central member, wherein the inner surface of said upper guide member is disposed near said output end of said central member and opposed to and offset from the upper vertex of said Z-shaped portion of said central member, thereby forming a segment guide channel, D. a rigid lower guide member having an inner surface with a substantially V-shaped cross-section and, E. means for positioning said rigid lower guide member adjacent to the lower surface of said central member, wherein said inner surface of said lower guide member is disposed near said output end and opposed to and offset from the lower vertex of said Z-shaped portion of said central member, thereby forming a segment guide channel.

27. Seam forming apparatus according to claim 26 further comprising means adjacent to said output end for drawing said limp material segments from said segment guide channels in the direction of said reference axis.

28. Seam forming apparatus according to claim 27 wherein said drawing means includes a feed dog assembly.

29. Seam forming apparatus according to claim 27 further comprising a seam joining apparatus including means for receiving said limp material segments from said drawing means along said reference axis and means for sewing said received limp material segments along a sewing axis substantially parallel to said reference axis.

30. Seam forming apparatus according to claim 25 further comprising means adjacent to said output end for drawing said limp material segments from said segment guide channels in the direction of said reference axis.

31. Seam forming apparatus according to claim 30 wherein said drawing means includes a feed dog assembly.

32. Seam forming apparatus according to claim 30 further comprising a seam joining apparatus including means for receiving said limp material segments from said drawing means along said reference axis and means for sewing said received limp material segments along a sewing axis substantially parallel to said reference axis.

* * * * *